US008912467B2

(12) United States Patent
Oishi et al.

(10) Patent No.: US 8,912,467 B2
(45) Date of Patent: Dec. 16, 2014

(54) HAIR STYLING HEATING APPARATUS

(71) Applicant: Manica Taiwan Incorporated, Taichung (TW)

(72) Inventors: Rie Oishi, Tokyo (JP); Feng-Chih Liao, Taichung (TW); Yen-Chin Cheng, Taichung (TW)

(73) Assignee: Manica Taiwan Incorporated, Taichung (TW)

( * ) Notice: Subject to any disclaimer, the term of this patent is extended or adjusted under 35 U.S.C. 154(b) by 119 days.

(21) Appl. No.: 13/713,777

(22) Filed: Dec. 13, 2012

(65) Prior Publication Data

US 2014/0166039 A1 Jun. 19, 2014

(51) Int. Cl.

| | |
|---|---|
| ***A45D 2/36*** | (2006.01) |
| ***A45D 4/16*** | (2006.01) |
| *H05B 6/10* | (2006.01) |

(52) U.S. Cl.

CPC ..... *A45D 2/367* (2013.01); *A45D 2/362* (2013.01); *H05B 6/105* (2013.01); *A45D 4/16* (2013.01)

USPC ..... 219/222; 219/618; 219/635; 132/233

(58) Field of Classification Search

None

See application file for complete search history.

(56) References Cited

U.S. PATENT DOCUMENTS

| | | | | |
|---|---|---|---|---|
| 3,575,182 | A * | 4/1971 | Leclabart | 132/234 |
| 3,665,939 | A * | 5/1972 | Laing | 132/233 |
| 3,701,882 | A * | 10/1972 | Yukio Wada et al. | 219/222 |
| 4,499,355 | A * | 2/1985 | Walter | 219/618 |
| 5,606,983 | A * | 3/1997 | Monty et al. | 132/229 |
| 5,798,404 | A * | 8/1998 | Monty et al. | 524/490 |
| 6,881,928 | B2 * | 4/2005 | Wong et al. | 219/222 |
| 2005/0056297 | A1 * | 3/2005 | Maione et al. | 132/231 |
| 2009/0165811 | A1 * | 7/2009 | Zimmerman | 132/203 |
| 2012/0132648 | A1 * | 5/2012 | Ingleby-Oddy | 219/635 |
| 2012/0267358 | A1 * | 10/2012 | Floyd | 219/635 |
| 2012/0292302 | A1 * | 11/2012 | Richmond et al. | 219/222 |
| 2013/0019891 | A1 * | 1/2013 | Cheung et al. | 132/229 |
| 2013/0019892 | A1 * | 1/2013 | Cheung et al. | 132/229 |

* cited by examiner

*Primary Examiner* — Joseph M Pelham

(74) *Attorney, Agent, or Firm* — Wang Law Firm, Inc.; Li K. Wang; Stephen Hsu

(57) ABSTRACT

A hair styler and its heating device which can heat the thermal storage piece inside the hair roller quickly to a desired temperature by electromagnetic heating. The thermal storage piece is made of high thermal conductivity material which absorbs heat quite quick and disposed inside the hair roller to prevent the hair from directly contacting the thermal storage piece during hair styling, consequently preventing the hair from being burned. Then a low thermal conductivity isolating layer retains the heat within the hair roller and enables the heat to be uniformly and constantly transmitted to the outer surface of the hair roller, providing an effect of low energy consumption and long-lasting heat. A temperature sensing piece is used to detect and indicate the temperature of the hair styler by using different colors, making it easier for the user to know the temperature of the hair styler.

13 Claims, 10 Drawing Sheets

HAIR STYLING HEATING APPARATUS

BACKGROUND OF THE INVENTION

1. Field of the Invention

The present invention relates to a hair styler and a heating device, and more particularly to an electromagnetically heated hair styler, and the temperature condition of the hair styler is easily recognizable.

2. Description of the Prior Art

FIGS. 1 and 2 show a conventional hair styler with an electric heating device 80, 800, wherein the electric heating device 80 comprises a base 81 and a plurality of connectors 82 suspending from the base 81 and electrically connected in pairs to a plurality of hair rollers 90 which are equipped with electric heating members 91. The electric heating device 800 shown in FIG. 2 is a hair clip equipped with an electric heating member 810 to heat a hair roller 900, so that the hair can be heated and styled by winding around the hair roller 900.

It is to be noted that, during hair styling by hot perming, perm lotion is usually used to modify the hair texture after rolling hair with hair rollers, then mold the hair into a desired style by heating, hence, temperature control is key to the hair styling effect. However, hair will form a certain thickness of hair layer after winding around the hair roller, so that, the hair at the top surface of the hair layer that touches the hair roller as shown in FIG. 1 and that touches the hair clip as shown in FIG. 2 will be subjected to a relatively high temperature as compared to the hair at the bottom of the hair layer, which will result in an ununiformity of heating, and consequently affecting the hair styling effect.

Besides, the conventional electric heating devices 80, 800 require constant power supply, therefore, the hair rollers 90, 900 need to be connected with a power line, which not only increases the size of the hair styler, but also makes the use of the hair styler inconvenient during hair styling. Furthermore, the hair styler is required to be maintained at the temperature of 120-180 Celsius degrees during the whole process of hair styling, which suffers the disadvantage of high energy consumption. Another disadvantage is that perm lotion used in hair styling will inevitably be brought into contact with the hair rollers and clips, which makes the hair rollers and clips difficult to clean and causes sanitation problem.

The present invention has arisen to mitigate and/or obviate the afore-described disadvantages.

SUMMARY OF THE INVENTION

The primary objective of the present invention is to provide a hair styler and its heating device, wherein the thermal storage piece inside the hair roller can be quickly heated to a desired temperature by electromagnetic heating. The thermal storage piece is made of high thermal conductivity material which can absorbs heat quite quick, and then a low thermal conductivity isolating layer retains the heat within the hair roller and enables the heat to be uniformly and constantly transmitted to the outer surface of the hair roller, providing an effect of low energy consumption and long-lasting heat.

Another objective of the present invention is to provide a hair styler and its heating device, wherein the hair roller is used in combination with a hair clip equipped with an electromagnetic heating unit, a space is defined between the hair roller and the hair clip to hold the hair, and heat energy can be uniformly accumulated in the space to heat the hair uniformly for a long period of time.

Yet another objective of the present invention is to provide a hair styler and its heating device, wherein a thermal storage piece is disposed inside the base of the hair roller or the hair clip, so as to prevent the hair from directly contacting the thermal storage piece during hair styling, and consequently preventing the hair from being burned.

Yet another objective of the present invention is to provide a hair styler and its heating device, wherein a plurality of thermal fins are arranged around the outer peripheral surface of the hair roller to fix the hair and to transmit heat to the outer layer of the hair, allowing the hair to be uniformly heated.

Yet another objective of the present invention is to provide a hair styler and its heating device, wherein a temperature sensing piece is used to detect and indicate the temperature of the hair styler by using different colors, making it easier for the user to know the temperature of the hair styler easily.

Yet another objective of the present invention is to provide a hair styler and its heating device, wherein the hair styler is electromagnetically heated, which offers the advantages of quick heating and simplifying the hair styler.

To achieve the above objectives, a hair styling heating apparatus in accordance with the present invention comprises a heating device and a hair styler. The heating device includes a housing which is formed with an inner space for holding the hair styler, in the housing is disposed an electromagnetic heating unit. The hair styler includes a base and a thermal storage piece inside the base, the thermal storage piece is made of steel and heated by the electromagnetic heating unit, the hair styler is disposed in the inner space of the heating device, heat is transmitted from the thermal storage piece inside the base to an outer surface of the base to heat hair.

To achieve the above objectives, a hair styling heating apparatus in accordance with the present invention comprises an electromagnetic heating device and a hair roller. The hair roller comprises a base which is formed with an inner chamber, an isolating layer on the inner surface of the inner chamber, and a thermal storage piece disposed on the isolating layer around an outer peripheral surface of the base are arranged a plurality of thermal fins to fix the hair winding around the hair roller, the isolating layer is made of mica, and the thermal storage piece is made of steel and rolled into an elastic roll structure to elastically press against the isolating layer. The heating device includes a housing which is formed with an inner space for holding the hair roller, in the housing is disposed an electromagnetic heating unit 42 which is used to heat the thermal storage piece, hair winds around the base of the hair roller, heat is transmitted from the thermal storage piece inside the base to an outer surface of the base to perform hair styling by heating the hair.

To achieve the above objectives, a hair styling heating apparatus in accordance with the present invention comprises a hair roller and a hair clip used in combination with an electromagnetic heating device. The hair roller includes a base, an isolating layer and a thermal storage piece inside the base, around an outer peripheral surface of the base are formed a plurality of thermal fins, the isolating layer is made of low thermal conductivity material, and the thermal storage piece is made of steel and rolled into an elastic roll structure to elastically press against the isolating layer. The hair clip includes a body formed by two clip members, and a torsion spring arranged between the two clip members, in each of the clip members is formed a steel made thermal storage layer. The heating device includes a housing which is formed with an inner space for holding the hair roller or the hair clip, in the housing is disposed an electromagnetic heating unit which is used to heat the thermal storage piece of the hair roller or the thermal storage layer of the hair clip. Hair winds around the hair roller and is fixed by the hair clip, heat of the thermal storage piece of the hair roller or the thermal storage layer of the hair clip is used to heat the hair.

DETAILED DESCRIPTION OF THE PREFERRED EMBODIMENTS

Figure 1:
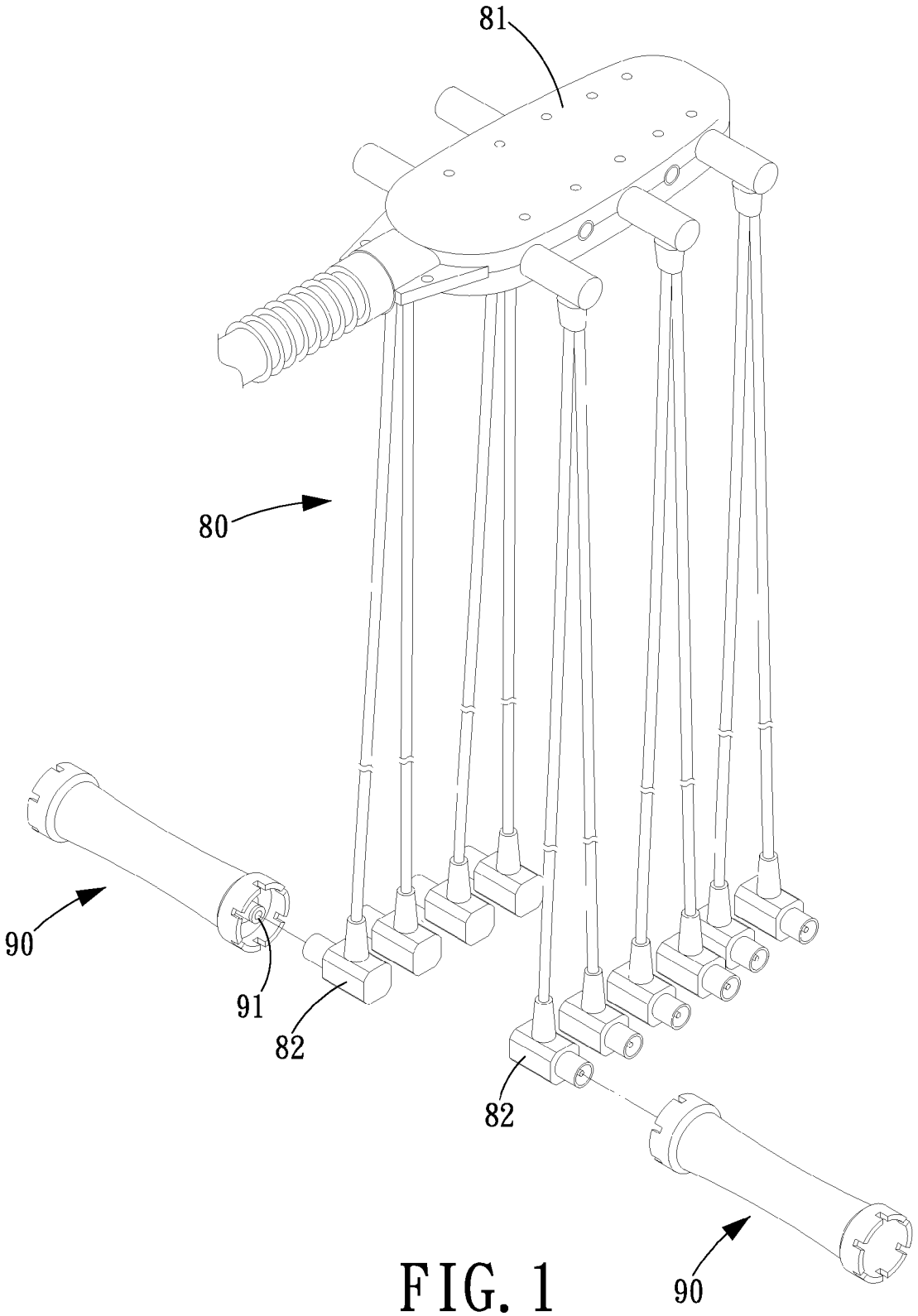
FIG. 1 PRIOR ART
FIG. 1 is a perspective view of a conventional hair roller with an electric heating device.
Figure 2:
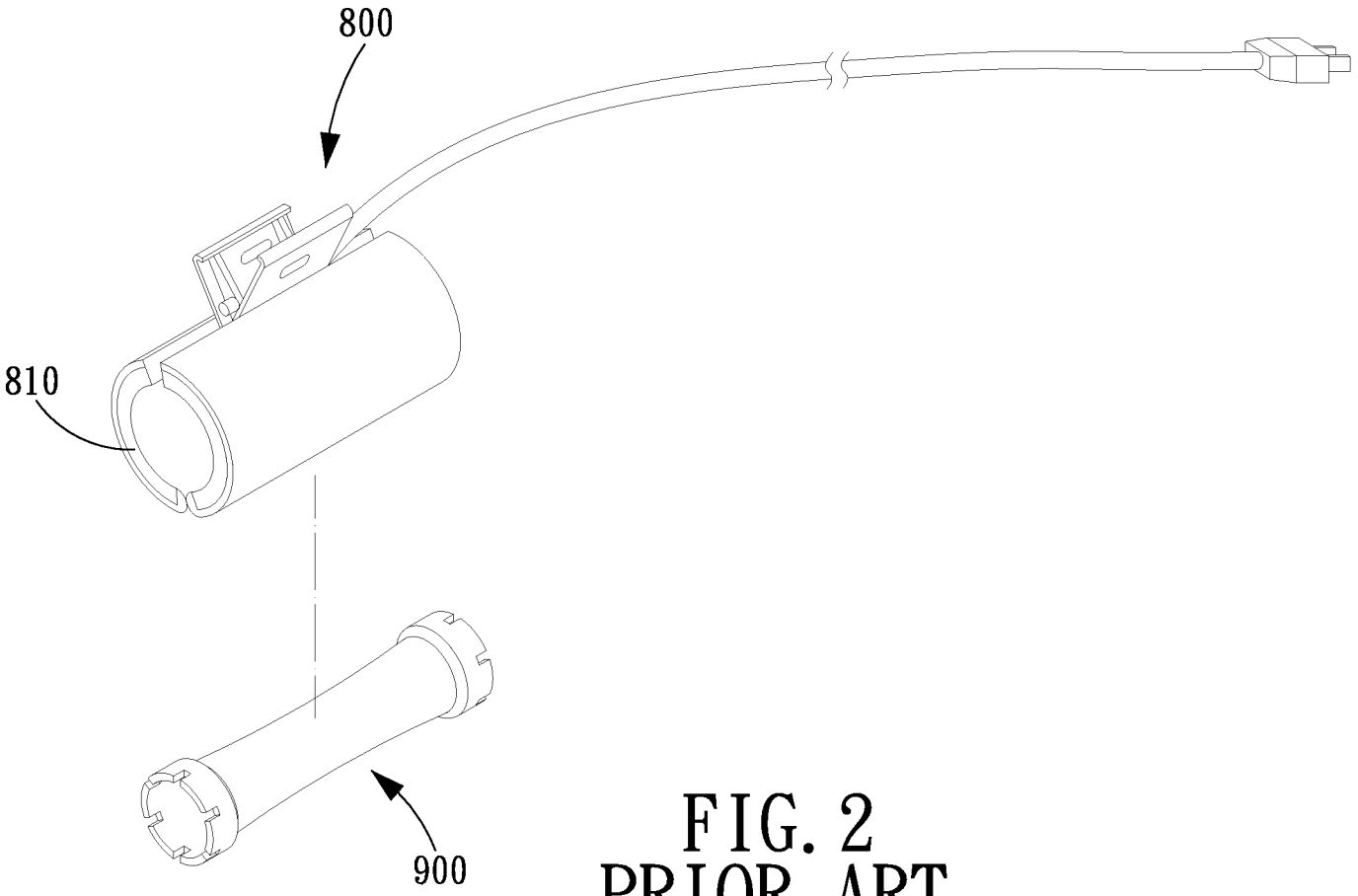
FIG. 2 PRIOR ART
FIG. 2 is a perspective view of a conventional hair clip with an electric heating device.
Figure 3:
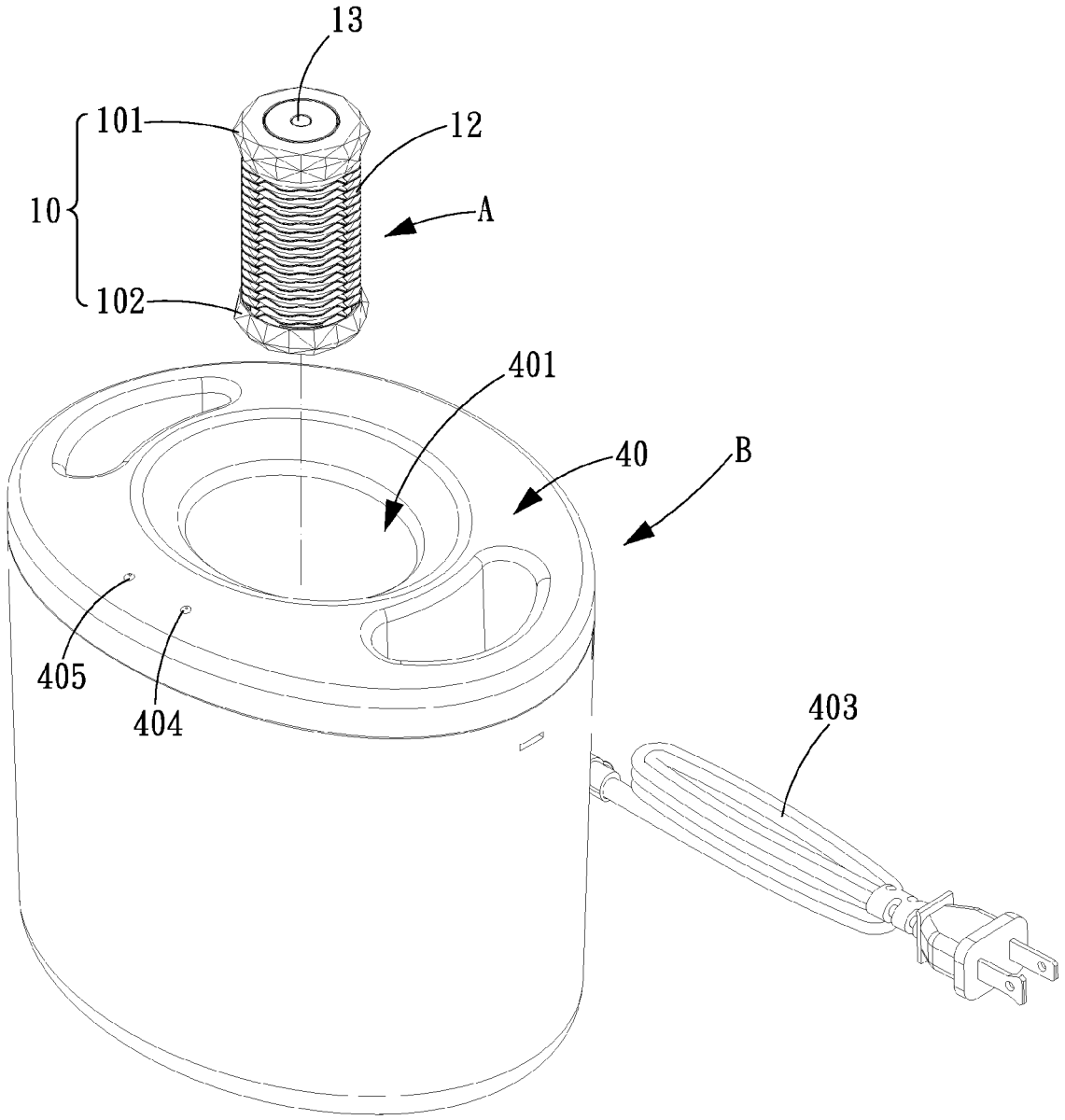
FIG. 3 is a perspective view of a hair roller and a heating device in accordance with the present invention.

The present invention will be clearer from the following description when viewed together with the accompanying drawings, which show, for purpose of illustrations only, the preferred embodiment in accordance with the present invention.

Referring to FIGS. 3-8, a hair styling heating apparatus in accordance with the present invention includes a heating device B and a hair styler which can be a hair roller A which is heated by the heating device B, wherein the heating device B comprises a housing 40 which is formed with an inner space 401 for holding and heating the hair roller A or a hair clip C. The housing 40 is provided on an outer surface thereof with a switch 402, a power line 403, a switch lamp 404 and a running lamp 405. In the housing 40 are disposed a control circuit 41, an electromagnetic heating unit 42 and a far infrared temperature sensor 43.

Figure 4:
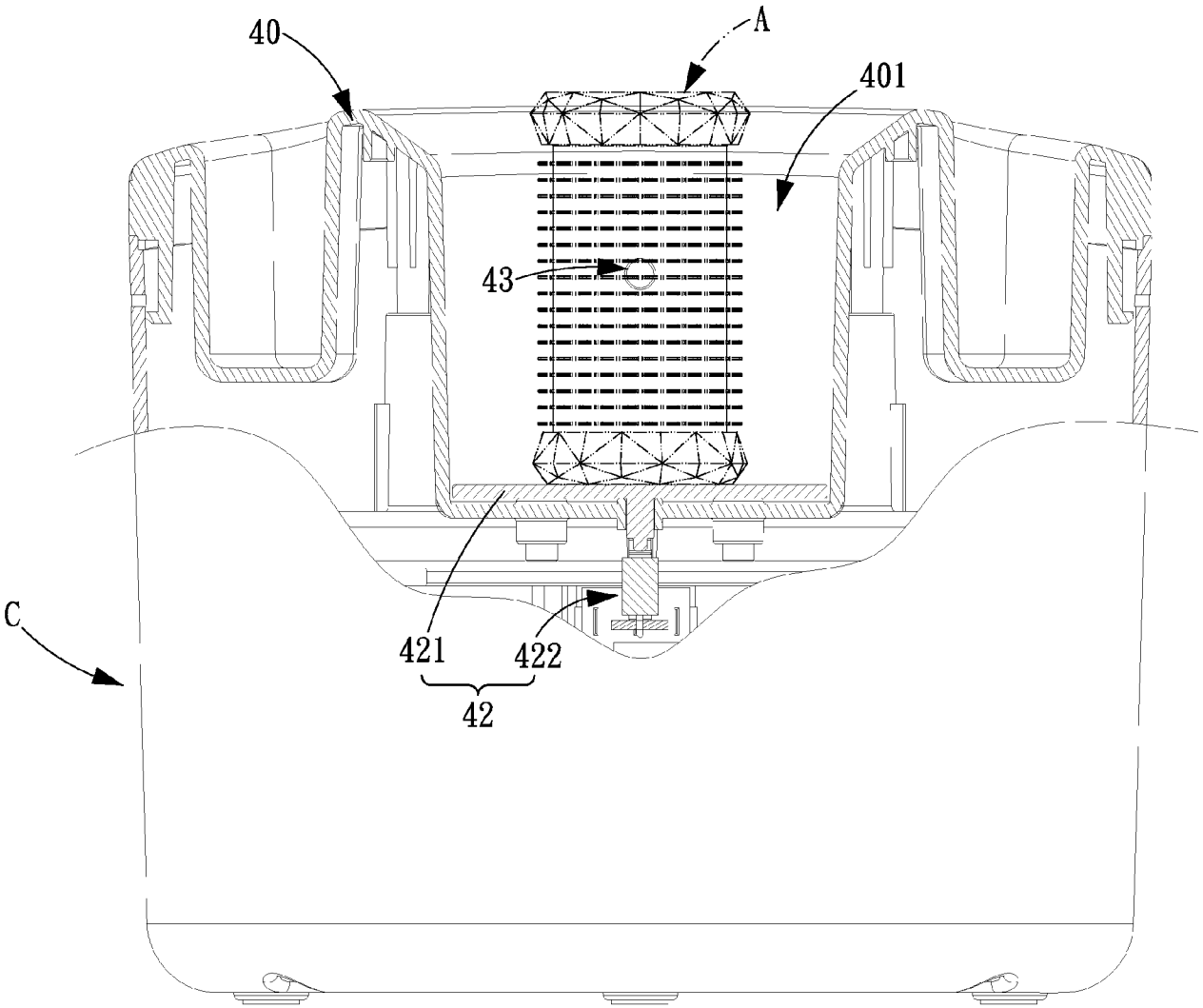
FIG. 4 is a cross sectional view of a hair roller and a heating device in accordance with the present invention.
Figure 5:
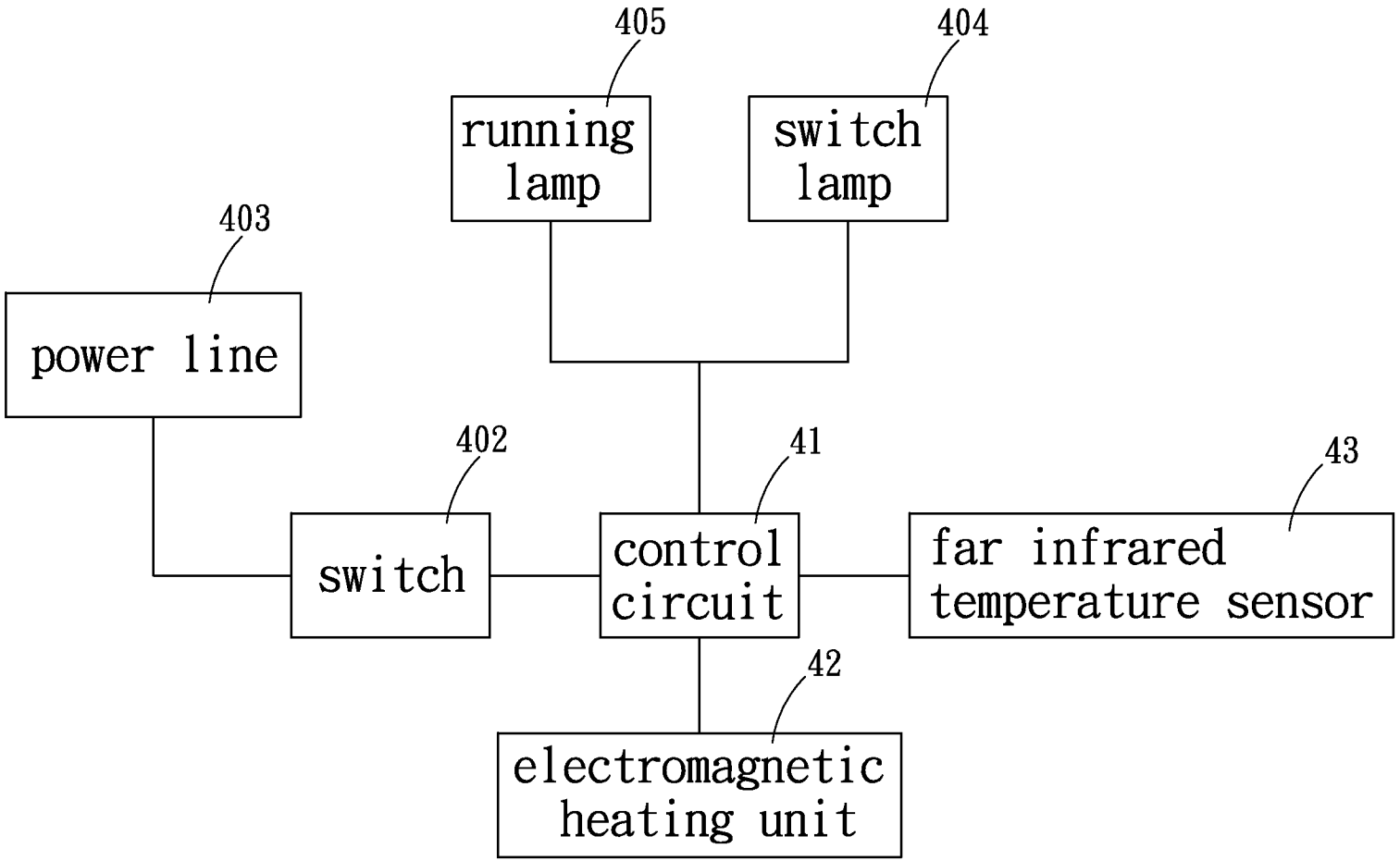
FIG. 5 is a block diagram showing the hair roller and the heating device in accordance with the present invention.

As shown in FIGS. 4 and 5, the control circuit 41 is electrically connected to the switch lamp 404 and then electrically connected to the power line 403 via the switch 402. The electromagnetic heating unit 42 includes a heating disc 421 disposed at an inner bottom of the inner space 401, and a heat generator 422 located at an outer bottom of the inner space 401. The heat generator 422 generates heat by electromagnetic induction and is controlled by the control circuit 41 to supply heat to the heating disc 421 to heat the hair roller A or the hair clip C disposed in the inner space 401 of the heating device B. The far infrared temperature sensor 43 is controlled by the control circuit 41 to sense the temperature of the hair roller A or the hair clip C by detecting the far infrared energy emitted from the hair roller A or the hair clip C. The far infrared temperature sensor 43 is electrically connected to the running lamp 405 via the control circuit 41 to indicate the heating condition of the hair styler by using different lamps.

Figure 6:
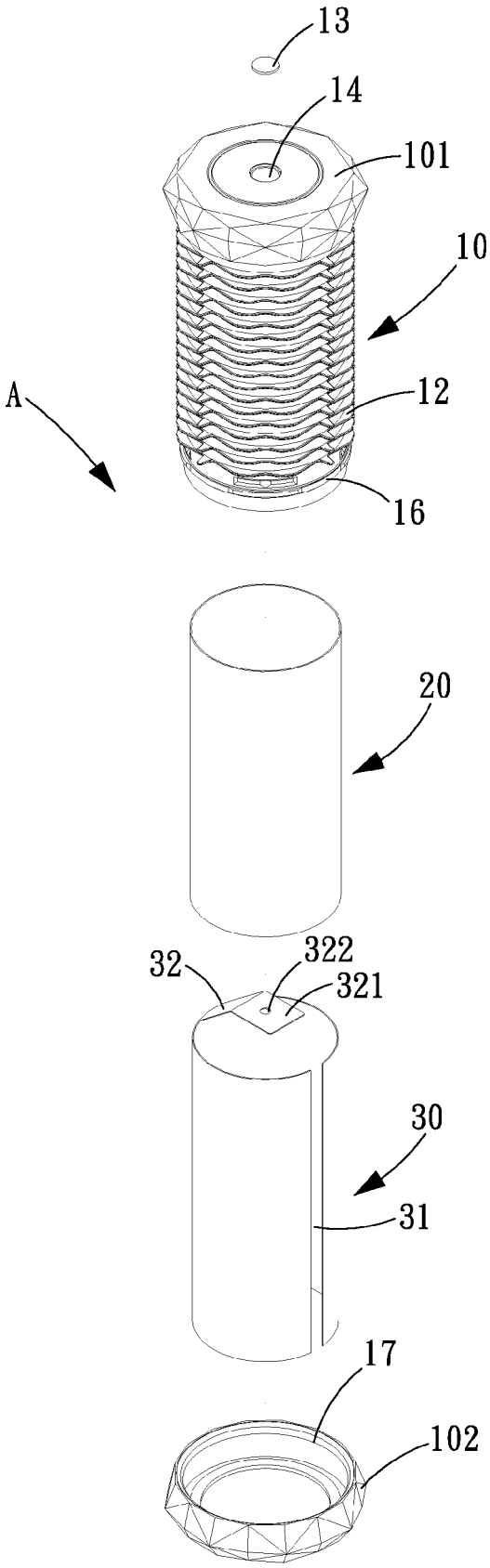
FIG. 6 is an exploded view of the hair roller in accordance with the present invention.
Figure 7:
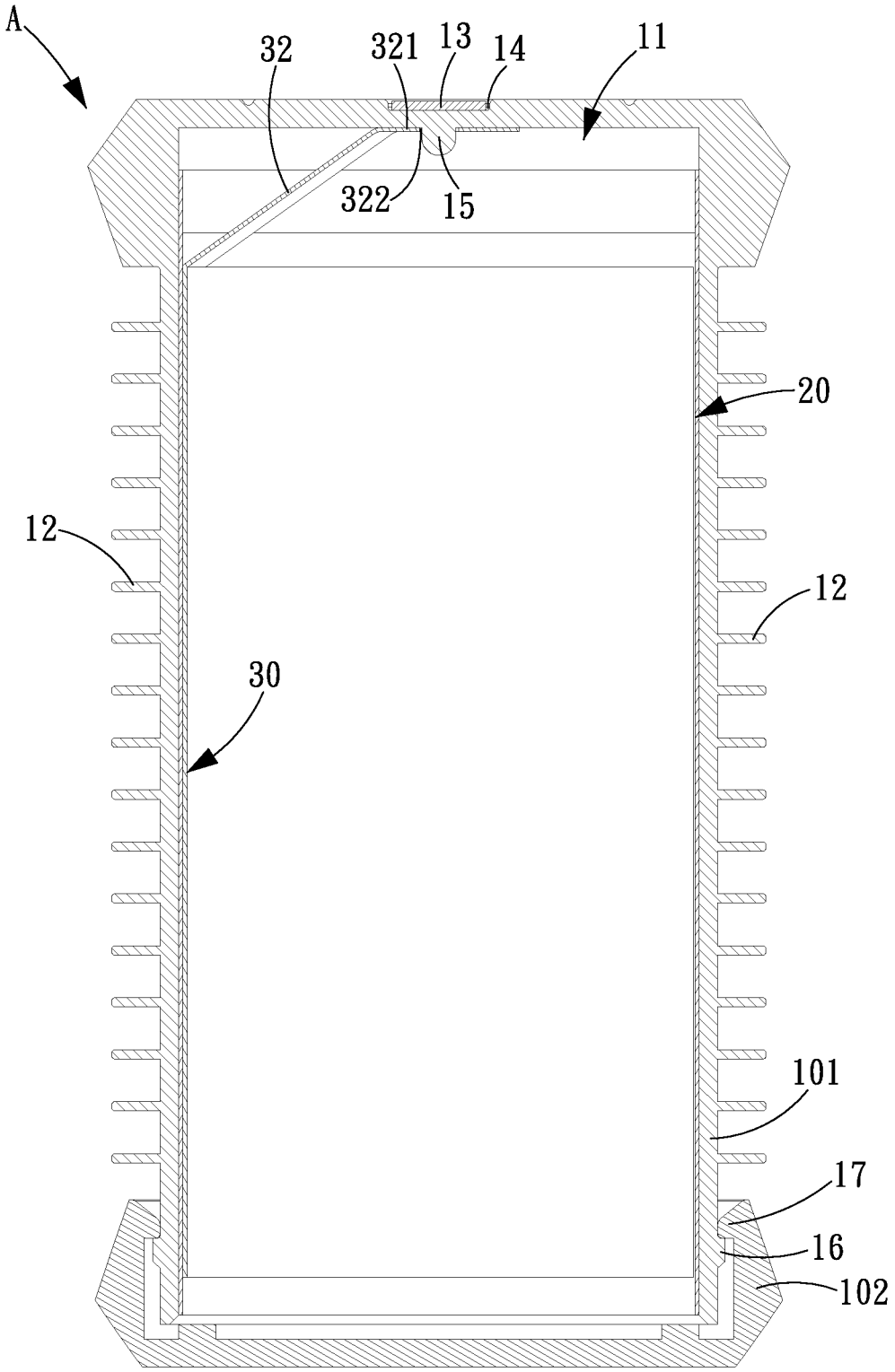
FIG. 7 is a cross sectional view of the hair roller in accordance with the present invention.
Figure 8:
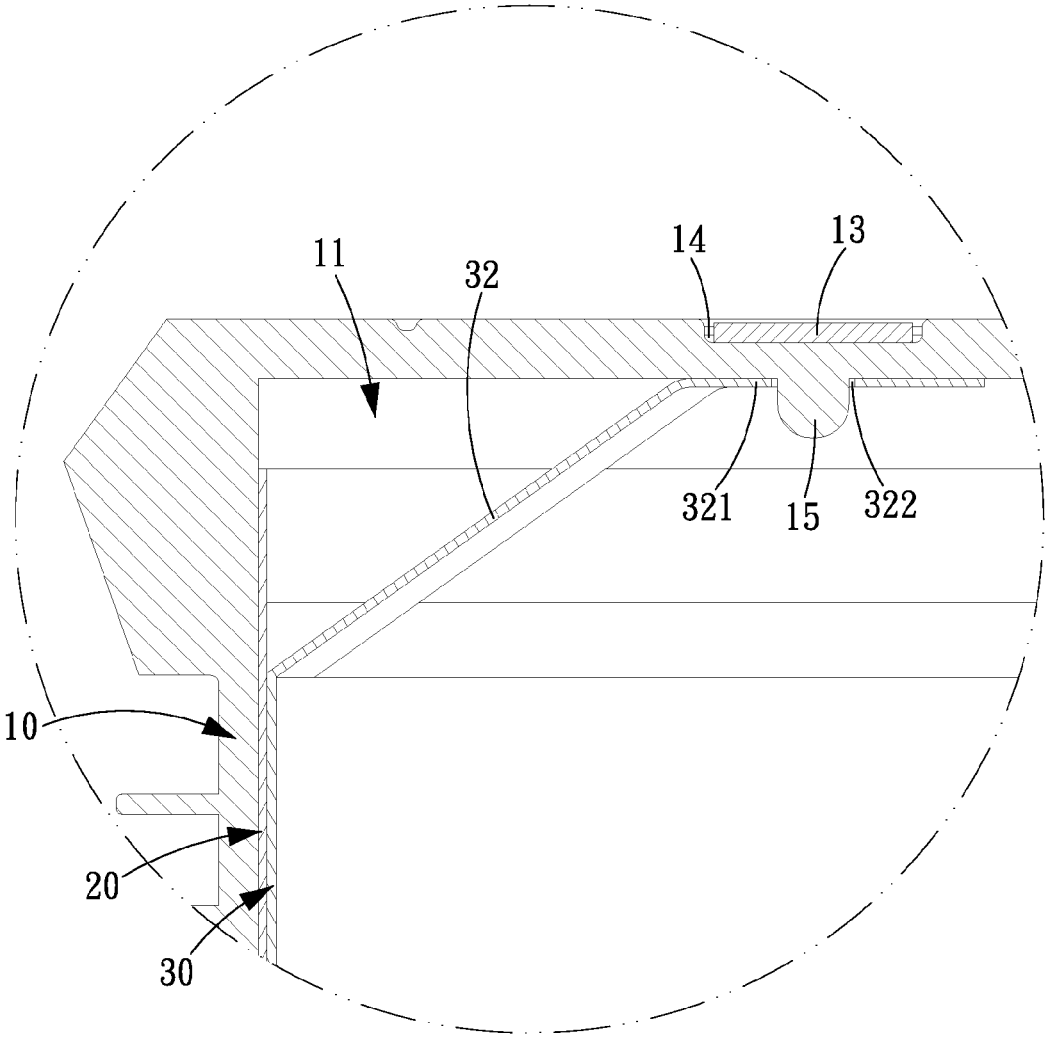
FIG. 8 is an enlarged view of a part of FIG. 7.

The hair styler of the present invention can be the hair roller A which can be used independently after being electromagnetically heated, or the hair styler of the present invention can be the combination of the hair roller A and the hair clip C. As shown in FIGS. 6-8, the hair roller A comprises a base 10 which is formed with an inner chamber 11, an isolating layer 20 on the inner surface of the inner chamber 11, and a thermal storage piece 30 disposed on the isolating layer 20. Around the outer peripheral surface of the base 10 are arranged a plurality of thermal fins 12 to fix the hair winding around the hair roller A and to transmit the heat from the hair roller A to the hair. The isolating layer 20 is made of low thermal conductivity material, and the thermal storage piece 30 is made of steel and rolled into an elastic roll structure to elastically press against the isolating layer 20, so that the thermal storage piece 30 and the isolating layer 20 are assembled together to form a temperature structure.

The heating device B of the present invention serves to quickly heat the hair roller A by using the steel made thermal storage piece 30. The thermal storage piece 30 is formed along the axial direction of the base 10 with a slot 31 which makes the thermal storage piece 30 expandable and flexible, so that the thermal storage piece 30 can be flexibly pressed against the isolating layer 20. The isolating layer 20 between the base 10 and the thermal storage piece 30 is able to retain the heat within the hair roller A. Besides, the isolating layer 20 which is made of low thermal conductivity material allows the heat to be evenly and smoothly distributed over the outer surface of the hair roller A via the base 10 and the thermal fins 12, so that temperature retaining structure of the hair roller A, after being heated, can be maintained at a relatively high temperature for a long time to enable the hair roller A to perform hair styling. The isolating layer 20 is preferably made of mica.

An end surface of the base 10 of the hair roller A is formed with an engaging groove 14 for holding a temperature sensing piece 13 whose color changes with temperature. One end of the thermal storage piece 30 extends toward the temperature sensing piece 13 to form a heat transmission piece 32 with a connecting section 321 which is to be pressed against the inner surface of the inner chamber 11 of the base 10. Heat stored in the thermal storage piece 30 of the hair roller A is transmitted to the base 10 via the heat transmission piece 32 to enable the temperature sensing piece 13 to detect the temperature condition of the hair roller A. For example, the color of the temperature sensing piece 13 is red at a room temperature, and will change into white when the temperature of the hair roller A reaches a predetermined value, so as to remind the user that the hair roller A has been heated to a desired temperature.

In this embodiment, as shown in FIG. 7, the base 10 consists of a shell 101 and a cover 102. The inner chamber 11 is formed inside the shell 101, the thermal fins 12 are provided on the outer surface of the shell 101, and the temperature sensing piece 13 is located at an end surface of the shell 101. The shell 101 is formed around an outer surface thereof adjacent to an open end of the inner chamber 11 with a positioning rib 16. The cover 102 is formed with an engaging flange 17 which is engaged with the positioning rib 16 of the shell 101 to form the hollow base 10. As shown in FIG. 8, the inner chamber 11 of the base 10 of the hair roller A is formed with a positioning boss 15 aligned with the engaging groove 14, and the connecting section 321 of the heat transmission piece 32 of the thermal storage piece 30 is formed with an engaging recess 322 for engaging with the positioning boss 15, so as to fix the heat transmission piece 32 to the base 10 of the hair roller A.

Figure 9:
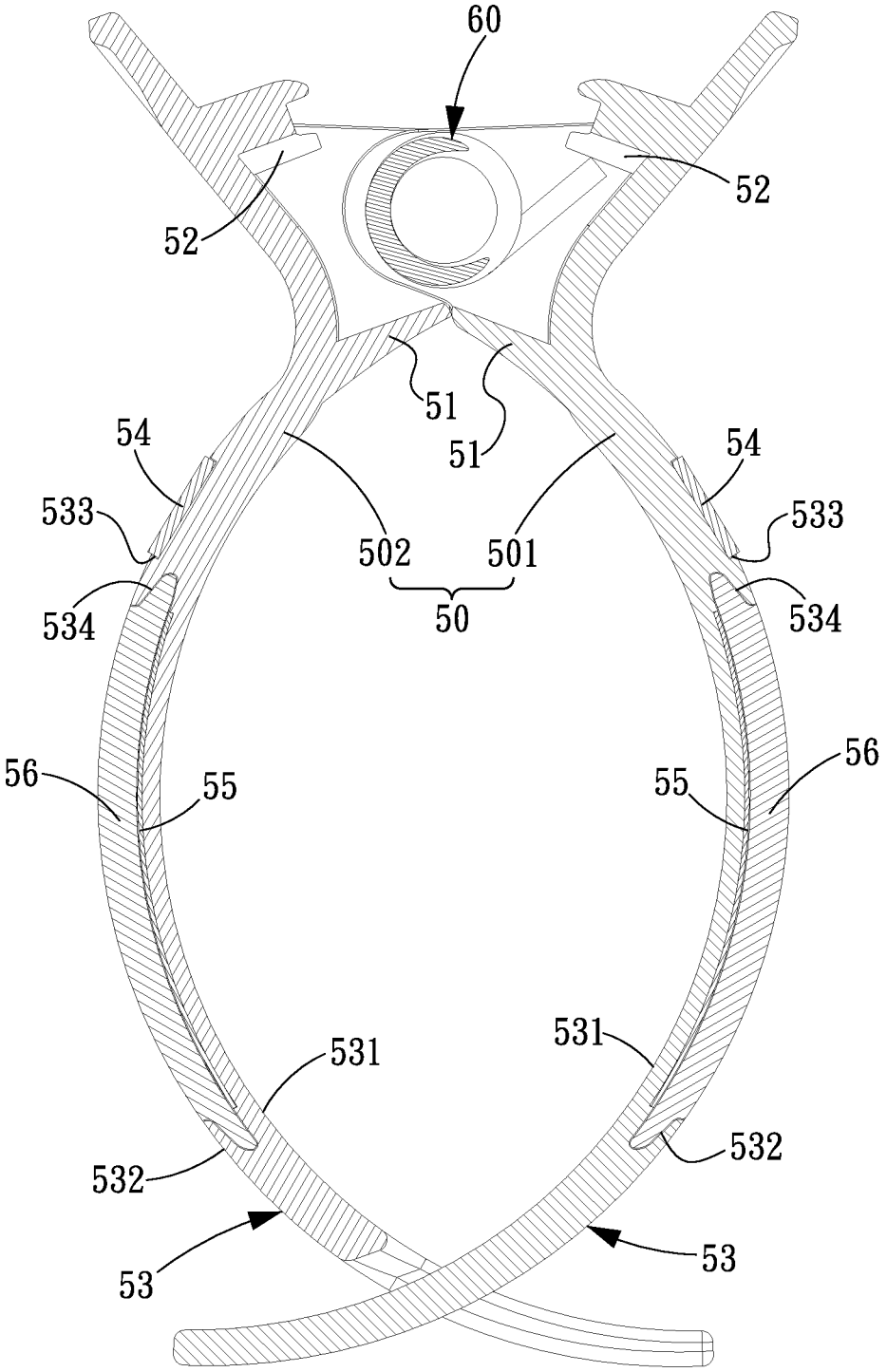
FIG. 9 is a cross sectional view of a hair clip in accordance with the present invention.
Figure 10:
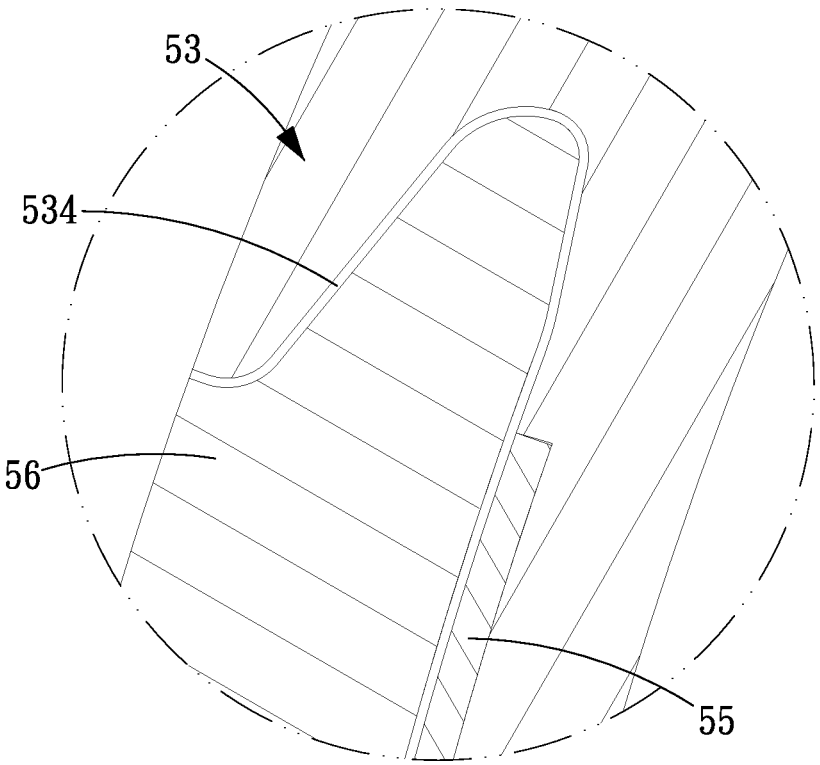
FIG. 10 is an enlarged view of a part of FIG. 9.

FIGS. 9 and 10 show another embodiment of the present invention, wherein the hair styler of the present invention is a hair clip C which is used in combination with a traditional hair roller or the abovementioned hair roller A which is heated in an electromagnetic way. The hair clip C includes a body 50 formed by two clip members 501, 502, and a torsion spring 60. Each of the clip members 501, 502 is formed with an abutting portion 51, and an engaging portion 52 and an arc-shaped portion 53 located at two sides of the abutting portion 51, respectively. Each of the arc-shaped portions 53 of the two clip members 501, 502 includes an inner arc-shaped surface 531 and an outer arc-shaped surface 532, in the outer arc-shaped surface 532 is embedded a temperature sensing piece 54 whose color changes with temperature, and between the inner and outer arc-shaped surfaces 531, 532 is disposed a steel made thermal storage layer 55 which serves as a temperature retaining structure of the hair clip C. The torsion spring 60 is disposed between the engaging portions 52 of the two clip members 501, 502 to make the two abutting portions 51 press against each other, and make the inner arc-shaped surfaces 531 of the two arc-shaped portions 53 elastically engaged with each other.

The hair roller A and the hair clip C are electromagnetically heated, and the two inner arc-shaped surfaces 531 of the two clip members 501, 502 are clamped against the outer periphery of the hair roller A to fix the hair winding around the roller A. The hair roller A and the hair clip C are uniformly heated by the temperature retaining structure, including the thermal storage layer 55 and the isolating layer 20, respectively, and the arc-shaped portions 53 of the hair clip C are clamped against the outer surface of the base 10 of the hair roller A so as to further reduce the heat dissipation of the hair roller A, maintaining the hair roller A at a relatively high temperature for a long time while preventing the hair from being brought into direct contact with the high temperature elements of the hair roller.

In this embodiment, each of the outer arc-shaped surfaces 532 of the arc-shaped portions 53 of the hair clip C is formed with a receiving groove 533 and an assembling groove 534. The temperature sensing piece 54 which changes color with temperature is received in the receiving groove 533 to indicate the temperature condition of the clip C. The assembling groove 534 is a stepped structure, the thermal storage layer 55 is disposed at a bottom of the assembling groove 534, and a positioning member 56 is disposed at the top of the assembling groove 534 to fix the thermal storage layer 55.

To summarize, the hair styler and the heating device of the present invention offer the following advantages:

1. using electromagnetic heating method to heat the high thermal conductivity steel made thermal storage piece 30, and then using the low thermal conductivity isolating layer 20 to transmit heat from the thermal storage piece 30 at a constant rate to the hair roller A. Hence, as compared to the conventional hair styler, the present invention has less electricity consumption and can maintain the hair roller A at a high temperature for a longer time.

2. thermal fins 12 around the outer peripheral surface of the base 10 of the hair roller A is used in combination with the hair clip C to allow hair to be more easily fixed and styled, and also allow the hair to be heated more uniformly.

3. the temperature sensing pieces 13, 54 make it easier to know the heating and temperature condition of the hair styler, preventing that the temperature is too low to effect the hair styling affect or the temperature is too high to burn the hair.

4. the electromagnetic heating method not only has the advantages of fast heating and low energy consumption, but also simplifies the hair styler, making the use of the hair styler easier.

While we have shown and described various embodiments in accordance with the present invention, it is clear to those skilled in the art that further embodiments may be made without departing from the scope of the present invention.

What is claimed is:

1. A hair styling heating apparatus comprising a heating device and a hair styler; wherein:

the heating device includes a housing which is formed with an inner space for holding the hair styler, in the housing is disposed an electromagnetic heating unit;

the hair styler includes a base and a temperature retaining structure inside the base, the temperature retaining structure is heated by the electromagnetic heating unit, the hair styler is disposed in the inner space of the heating device, heat is transmitted from the temperature retaining structure inside the base to an outer surface of the base to heat hair;

the housing is provided on an outer surface thereof with a switch, a power line, a switch lamp and a running lamp;

a control circuit is disposed in the housing and electrically connected to the switch lamp and then electrically connected to the power line via the switch;

the electromagnetic heating unit includes a heating disc disposed at an inner bottom of the inner space, and a heat generator located at an outer bottom of the inner space, the heat generator generates heat by electromagnetic induction and is controlled by the control circuit to supply heat to the heating disc to heat the hair styler.

2. The hair styling heating apparatus as claimed in claim 1, wherein a far infrared temperature sensor is disposed in the inner space and controlled by the control circuit to sense the temperature of the hair styler by detecting far infrared energy emitted from the hair styler.

3. The hair styling heating apparatus as claimed in claim 1, wherein the hair styler is a hair roller which includes the base and the temperature retaining structure which consists of a thermal storage piece and an isolating layer; wherein:

the base is formed with an inner chamber, around an outer peripheral surface of the base are arranged a plurality of thermal fins, at an end surface of the base is provided a temperature sensing piece whose color changes with temperature;

the isolating layer is disposed in the inner chamber;

the thermal storage piece is made of steel and rolled into an elastic roll structure, the thermal storage piece is formed along an axial direction of the base with a slot which makes the thermal storage piece expandable and flexible, so that the thermal storage piece is capable of flexibly pressing against the isolating layer, one end of the thermal storage piece extends toward the temperature sensing piece to form a heat transmission piece with a connecting section which is to be pressed against the inner surface of the inner chamber of the base.

4. The hair styling heating apparatus as claimed in claim 3, wherein an end surface of the base is formed with an engaging groove for holding the temperature sensing piece, the inner chamber of the base is formed with a positioning boss aligned with the engaging groove, and the connecting section of the heat transmission piece of the thermal storage piece is formed with an engaging recess for engaging with the positioning boss, so as to fix the heat transmission piece to the base.

5. The hair styling heating apparatus as claimed in claim 3, wherein the base comprises a shell and a cover, the inner chamber is formed inside the shell, the thermal fins are provided on an outer surface of the shell, and the temperature sensing piece is located at an end surface of the shell, the shell is formed around an outer surface thereof adjacent to an open end of the inner chamber with a positioning rib, the cover is formed with an engaging flange which is engaged with the positioning rib of the shell to form the hollow base.

6. The hair styling heating apparatus as claimed in claim 3, wherein the isolating layer is made of mica.

7. The hair styling heating apparatus as claimed in claim 1, wherein the hair styler is a hair clip which includes a body and a torsion spring;

the body is formed by two clip members, and each of the clip members is formed with an abutting portion, and an engaging portion and an arc-shaped portion located at two sides of the abutting portion, respectively, each of the arc-shaped portions of the two clip members includes an inner arc-shaped surface and an outer arc-shaped surface, in the outer arc-shaped surface is embedded a temperature sensing piece whose color changes with temperature, and between the inner and outer arc-shaped surfaces is disposed a steel made thermal storage layer;

the torsion spring is disposed between the engaging portions of the two clip members to make the two abutting portions press against each other, and make the inner arc-shaped surfaces of the two arc-shaped portions elastically engaged with each other;

the hair clip is electromagnetically heated and used in combination with the hair roller in such a manner that the two inner arc-shaped surfaces of the two clip members are clamped against the outer periphery of the hair roller to fix the hair winding around the roller, and the body is located between the hair and the thermal storage layer of the hair clip to generate and transmit heat.

8. The hair styling heating apparatus as claimed in claim 7, wherein each of the outer arc-shaped surfaces of the arc-shaped portions of the hair clip is formed with a receiving groove and an assembling groove, the temperature sensing piece 54 is received in the receiving groove, the thermal storage layer is disposed at a bottom of the assembling groove, and a positioning member is used to fix the thermal storage layer.

9. A hair styling heating apparatus comprising an electromagnetic heating device and a hair roller; wherein:

the hair roller comprises a base which is formed with an inner chamber, an isolating layer on the inner surface of the inner chamber, and a thermal storage piece disposed on the isolating layer, around an outer peripheral surface of the base are arranged a plurality of thermal fins to fix the hair winding around the hair roller, the isolating layer is made of mica, and the thermal storage piece is made of steel and rolled into an elastic roll structure to elastically press against the isolating layer;

the heating device includes a housing which is formed with an inner space for holding the hair roller, in the housing is disposed an electromagnetic heating unit which is used to heat the thermal storage piece, hair winds around the base of the hair roller, heat is transmitted from the thermal storage piece inside the base to an outer surface of the base to perform hair styling by heating the hair.

10. The hair styling heating apparatus as claimed in claim 9, wherein the thermal storage piece is formed along an axial direction of the base with a slot which makes the thermal storage piece expandable and flexible, so that the thermal storage piece is capable of flexibly pressing against the isolating layer.

11. The hair styling heating apparatus as claimed in claim 9, wherein an end surface of the base is provided with a temperature sensing piece whose color changes with temperature, one end of the thermal storage piece extends toward the temperature sensing piece to form a heat transmission piece with a connecting section which is to be pressed against the inner surface of the inner chamber of the base, heat stored in the thermal storage piece of the hair roller is transmitted to the base via the heat transmission piece to enable the temperature sensing piece to detect temperature condition of the hair roller.

12. The hair styling heating apparatus as claimed in claim 9 further comprising a hair clip which is used in combination with the hair roller, the hair clip includes a body formed by two clip members, and a torsion spring, each of the clip members is formed with an arc-shaped portion, each of the arc-shaped portions of the two clip members includes an inner arc-shaped surface and an outer arc-shaped surface, and between the inner and outer arc-shaped surfaces is disposed a steel made thermal storage layer, the torsion spring is disposed between the engaging portions of the two clip members to make the two abutting portions press against each other, hair winds around the hair roller and is fixed by the hair clip, heat of the thermal storage layer of the hair clip and the isolating layer of the hair roller is used to heat the hair.

13. A hair styling heating apparatus comprising a hair roller and a hair clip used in combination with an electromagnetic heating device; wherein the hair roller includes a base and a temperature retaining structure inside the base, the temperature retaining structure includes an isolating layer and a thermal storage piece, around an outer peripheral surface of the base are formed a plurality of thermal fins, and the thermal storage piece is made of steel and rolled into an elastic roll structure to elastically press against the isolating layer;

the hair clip includes a body formed by two clip members, and a torsion spring arranged between the two clip members, in each of the clip members is formed a steel made thermal storage layer;

the heating device includes a housing which is formed with an inner space for holding the hair roller or the hair clip, in the housing is disposed an electromagnetic heating unit which is used to heat the thermal storage piece of the hair roller or the thermal storage layer of the hair clip;

hair winds around the hair roller and is fixed by the hair clip, heat of the thermal storage piece of the hair roller or the thermal storage layer of the hair clip is used to heat the hair.

* * * * *